US005105736A

United States Patent [19]

Morris

[11] Patent Number: 5,105,736

[45] Date of Patent: Apr. 21, 1992

[54] COMPACTION APPARATUS FOR METALLIC DRUMS WITH A HINGE SPINDLE SAFETY SWITCH

[76] Inventor: Drew W. Morris, P.O. Box 10111, Greenville, S.C. 29603

[21] Appl. No.: 458,243

[22] Filed: Dec. 28, 1989

[51] Int. Cl.[5] ..... B30B 15/16

[52] U.S. Cl. ..... 100/53; 100/255

[58] Field of Search ..... 100/255, 252, 53, 246, 100/240

[56] References Cited

U.S. PATENT DOCUMENTS

| | | | |
|---|---|---|---|
| 244,276 | 5/1877 | Bachmann | 100/255 |
| 4,022,123 | 5/1977 | Bachmann | 100/229 R |
| 4,554,868 | 11/1985 | Zimmer | 100/229 R |
| 4,559,870 | 12/1985 | Krummacher et al. | 100/215 |
| 4,696,227 | 9/1987 | Van Buskirk | 100/902 |
| 4,771,686 | 9/1988 | Triantos | 100/255 |

*Primary Examiner*—Paul T. Sewell
*Assistant Examiner*—Thomas P. Hilliard
*Attorney, Agent, or Firm*—Bailey & Hardaway

[57] ABSTRACT

An octagonal housing having three sides thereof forming a door for receipt of a large metallic drum. The housing has an octagonal top space which matingly contains an octagonal pressure plate which is engagable by a hydraulic ram for compressing a drum between the octagonal pressure plate and a base supporting the housing.

1 Claim, 3 Drawing Sheets

COMPACTION APPARATUS FOR METALLIC DRUMS WITH A HINGE SPINDLE SAFETY SWITCH

BACKGROUND OF THE INVENTION

This invention relates generally to the art of compaction and more particularly for an apparatus to compressing large metallic drums for volume reduction thereof.

An environmental interest in recycling of many products has brought about a need for compaction of such products as a part of the recycling or disposal thereof With regard to beverage containers, a variety of devices have been developed. One such apparatus is described in U.S. Pat. No. 4,771,686 to Triantos, Jr. Another such device is described in U.S. Pat. No. 4,696,227 to Van Buskirk.

Refuse, of course, has always been subject to compaction and an exemplary device is disclosed in U.S. Pat. No. 4,554,868 to Zimmer.

In the industrial area, no satisfactory device has been available for the compaction of large metallic drums such as 55 gallon drums normally used for shipment of flowable material.

SUMMARY OF THE INVENTION

It is thus an object of this invention to provide a novel compaction apparatus.

It is a further and more particular object of this invention to provide such an apparatus for the compaction of large metallic drums.

These as well as other objects are accomplished by an octagonal housing having three sides thereof forming a door for receipt of a large metallic drum. The housing has an octagonal top opening which matingly receives an octagonal pressure plate which is engagable by a hydraulic ram for compressing a drum between the octagonal pressure plate and a base supporting the housing.

DETAILED DESCRIPTION

In accordance with this invention, it has been found that large metallic drums may be easily and efficiently compacted so as to provide for disposal or recycling thereof in a space-efficient manner. Various other advantages and features will become apparent from the reading of the following description given with reference to the various figures of drawings.

Figure 1:
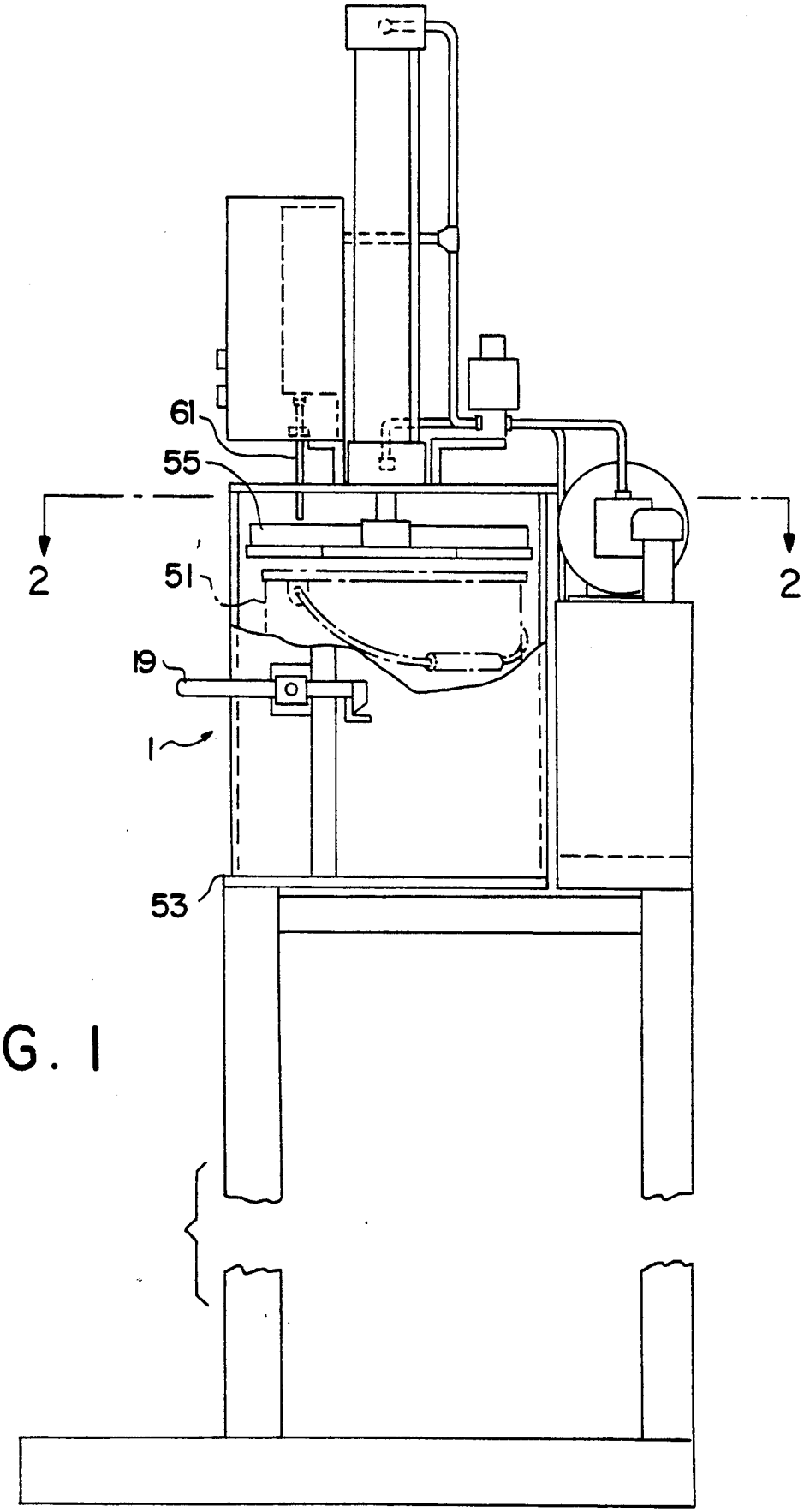
FIG. 1 of the drawings is a front view of the apparatus in accordance with this invention.

FIG. 1 of the drawings is a front view of the apparatus 1 of this invention. The apparatus refers to FIG. 2 which is a top view of FIG. 1. It is seen that the apparatus comprises five (5) housing walls 3, 5, 7, 9 and 11 which form a portion of an octagon. Three remaining sides of the octagon are provided by a three-sided door 15 which has a latch 19 thereon for engagement by catch 21 mounted on wall 3. Opposite catch 21 on wall 11 is a hinge 23 on which door 15 is hinged by hinge spindle 31 fixedly mounted to door 15, better illustrated in FIG. 2 of the drawings. Hinge spindle 31 thus passes through hinge 23 to permit opening and closing of door 15. Upon opening of door 15, an octagonal space is available for the placement of a 55 gallon drum therein, illustrated generally at 51 of FIG. 1. The metallic drum 51, rests upon a base 53 which supports the octagonal housing formed by the door 15 and the five-sided housing walls. A pressure plate 55 and an associated hydraulic cylinder 57 form a hydraulic ram for applying pressure through the upper octagonal space 59 which matingly receives the octagonal pressure plate 55.

Metallic drum 51 thus upon activation of the hydraulic ram is compressed by pressure plate 55 between pressure plate 55 and base 53.

Figure 3:
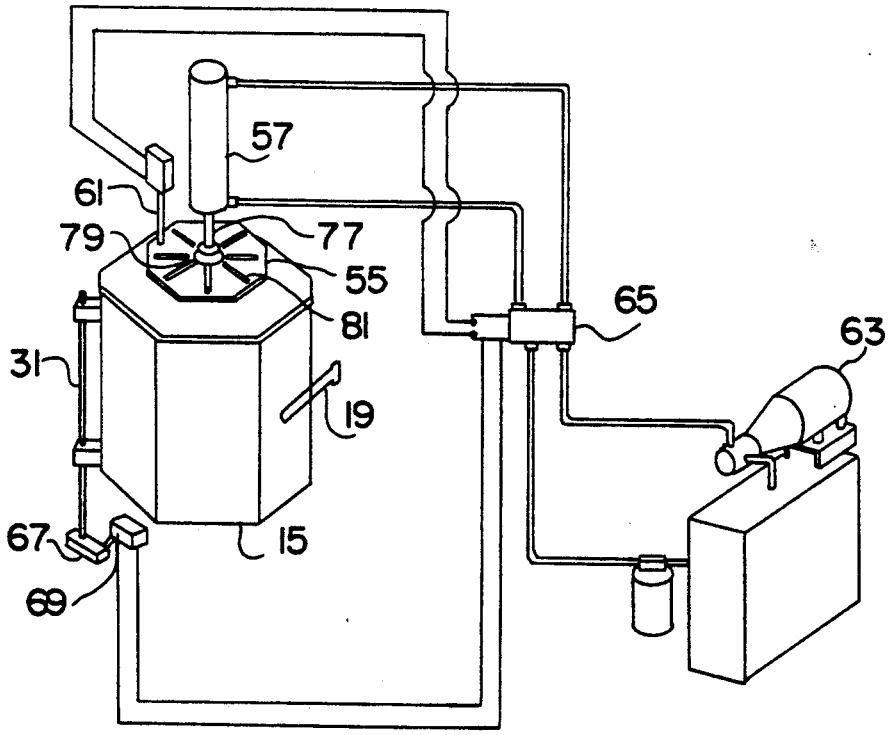
FIG. 3 of the drawings is a partial perspective view of various components of the invention.

After compression of a drum, pressure plate 55 is moved again to the position illustrated in FIG. 1 where its upward movement is limited by a limit switch 61 associated with the hydraulic pumping equipment as best illustrated in partial view of the apparatus in FIG. 3. It is seen that the limit switch 61, upon activation, will disengage the hydraulic pump assembly 63 through switching device 65. Switching device 65 is also in engagement with a door interlock system which is further described below.

Figure 4:
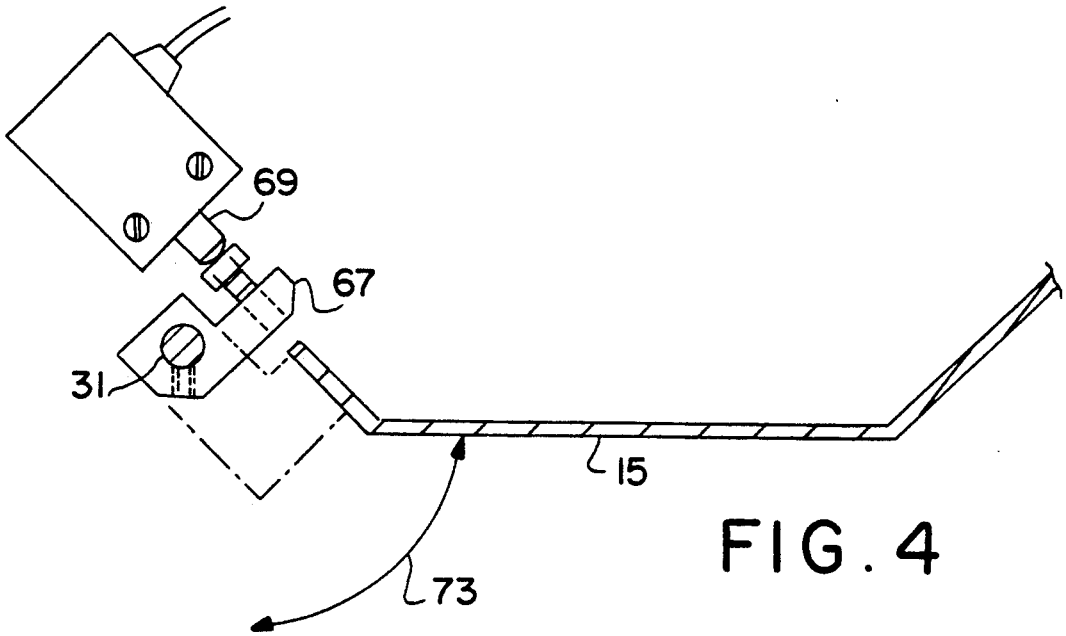
FIG. 4 of the drawings is an enlarged partial bottom view of the door interlock assembly.

The door interlock system is formed by hinge spindle 31 passing through base 53 where it has an associated cam 67 which engages switch 69 when door 15 is in the closed position and latch 19 is in a position to engage catch 21. A better view of the door interlock system is illustrated in FIG. 4 which is generally a bottom partial view illustrating movement of door 15 by the arc of arrow 73 causing movement of cam 67 into and out of engagement with switch 69 thus when switch 69 is depressed, switching mechanism permits movement of hydraulic fluid into cylinder 57. If door 15 is ajar or becomes ajar during operation, movement of pressure plate 55 will cease.

Figure 2:
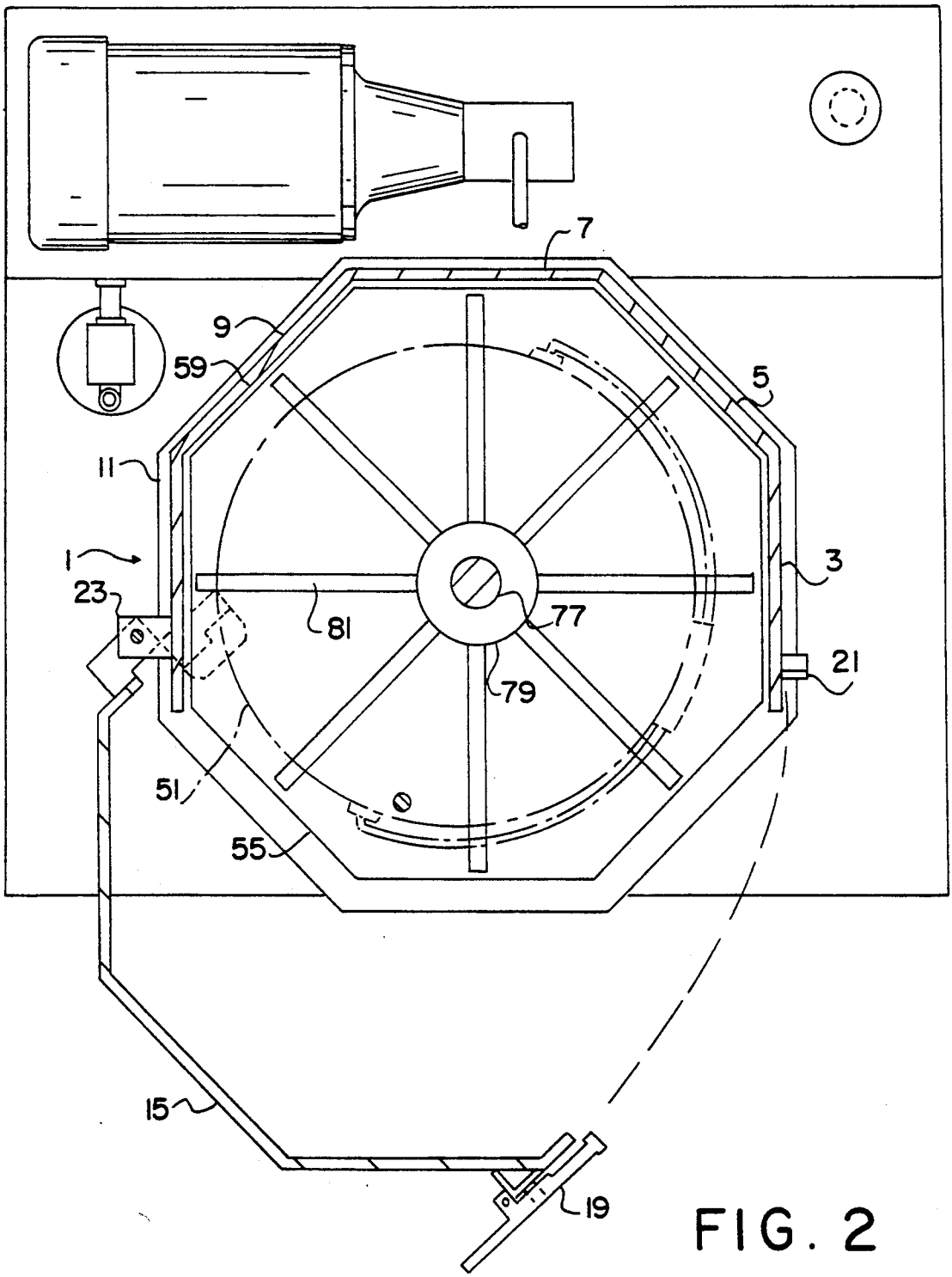
FIG. 2 of the drawings is a view along the line 2—2 of FIG. 1.

Pressure plate 55 is engaged by ram 77 on a central support 79 best illustrated in FIG. 2. Eight (8) support rods 81 extend outward from central support 79 for transmitting the force from ram 77 to pressure plate 55 and maintaining the appropriate configuration of pressure plate 55 during the compressing operation.

It is thus seen that the apparatus of this invention provides a compact and efficient apparatus for the compression of large metallic drums. The octagonal configuration of the components has been found to be an optimum configuration for the application of pressure to metallic drums while maintaining a suitable clearance between the drums and a manageable overall cross-section for utilization within a facility.

It is thus seen that a novel apparatus for compaction has been provided. It is further seen that such an apparatus possesses the ability to compress large metallic drums. As many modifications and variations will become apparent to those who are skilled in the art from a reading of the foregoing description, such variations are embodied within the spirit and scope of this invention as defined by the following appended claims.

That which is claimed is:

1. An apparatus for compressing metallic drums comprising:

a five-sided housing wall;

a hinge on said housing wall;

a catch on said housing wall opposite said hinge;

a three-sided door hinged to said hinge;

a latch on said door, engagable with said catch whereby an octagonal housing is formed when said latch of said three-sided door engages said catch, said octagonal housing defining an upper octagonal space;

a base supporting said octagonal housing;

an octagonal pressure plate matingly movable through said octagonal housing from said upper octagonal space;

a hydraulic ram engaging said pressure plate for movement from said octagonal space toward said base;

a safety switch in communication with said hydraulic ram to permit operation of said hydraulic ram only when said switch is depressed;

a hinge spindle movable with said three-sided door and passing through said hinge and said base;

a cam rotatable on said hinge spindle below said base;

said cam engaging said safety switch when said three-sided door is in position for engagement of said catch by said latch to thereby permit operation of said hydraulic ram only when said three-sided door is in a closed position and to cause deactivation of said hydraulic ram when said three-sided door is in a position other than said closed position.

* * * * *